United States Patent [19]

Kanne

[11] Patent Number: 5,004,480

[45] Date of Patent: Apr. 2, 1991

[54] AIR POLLUTION REDUCTION

[75] Inventor: Diane D. Kanne, Yorba Linda, Calif.

[73] Assignee: Union Oil Company of California, Los Angeles, Calif.

[21] Appl. No.: 200,757

[22] Filed: May 31, 1988

[51] Int. Cl.[5] ..... C10L 1/18

[52] U.S. Cl. ..... 44/387

[58] Field of Search ..... 44/57, 70, 56, 387; 252/386

[56] References Cited

U.S. PATENT DOCUMENTS

| | | | |
|---|---|---|---|
| 2,331,386 | 10/1943 | Gaylor | 44/70 |
| 2,844,448 | 7/1956 | Heisler et al. | 44/70 |
| 2,844,449 | 7/1958 | Dille et al. | 44/70 |
| 2,844,450 | 7/1958 | Heisler et al. | 44/70 |
| 2,932,618 | 4/1960 | Oberdorfer, Jr. | 44/70 |
| 2,935,479 | 5/1960 | Oberdorfer, Jr. | 252/170 |
| 3,817,720 | 6/1974 | Moy et al. | 44/56 |
| 4,240,802 | 12/1980 | Nichols, Jr. | 44/58 |
| 4,380,455 | 4/1983 | Smith | 44/56 |
| 4,600,408 | 7/1986 | Jessup et al. | 44/70 |

*Primary Examiner*—Margaret B. Medley

*Attorney, Agent, or Firm*—Gregory F. Wirzbicki; Arthur E. Oaks; Michael A. Kondzella

[57] ABSTRACT

Diesel fuel compositions containing dimethyl carbonate reduce pollution levels resulting when said fuel is combusted in a diesel engine.

48 Claims, No Drawings

AIR POLLUTION REDUCTION

BACKGROUND OF THE INVENTION

This invention relates to reducing atmospheric pollution during the combustion of diesel and other hydrocarbon fuels. The invention further relates to organic additives useful for reducing carbon monoxide, soot, smoke, and particulate emissions formed during the combustion of hydrocarbon fuels.

When fuel and air are mixed and ignited in the combustion chamber of an internal combustion engine, most of the fuel is burned to produce carbon dioxide and water which is discharged into the air with the engine exhaust gases. However, because the fuel and air are present in the combustion chamber for a finite period and the fuel and air have only a finite length of time to react at the temperatures and pressures present within the engine's combustion chamber, some of the fuel does not burn, is only partially burned, or reacts by itself without interacting with oxygen. The result of this time limitation is that other products, namely, carbon monoxide, hydrocarbons, and solid carbonaceous particulate matter, form during fuel combustion, and these are also discharged into the air.

The particulate matter formed during the combustion of hydrocarbon fuels, especially middle distillate fuels, such as diesel fuels, and residual fuels, such as non-distillate fuel oils, is commonly referred to as soot. When present in sufficient particle size and quantity, soot in engine, boiler or burner exhaust gases appears as a dense black plume. This is highly undesirable since it results in environmental pollution, engine design limitations, and possible health problems.

Diesel-type engines are well known for being highly durable and fuel efficient. Because of this durability and fuel efficiency, diesel-type engines have long been used in heavy-duty motor vehicles, such as trucks, buses, locomotives, and marine engines. Recently, however, concern over the contribution of diesel solid particulate emissions to decreasing atmospheric visibility in urban areas and potential health hazards has led to the United States Environmental Protection Agency promulgating a set of exhaust emission standards for heavy-duty diesel engines at 40 CFR 86, subpart A. In regard to combustion particulates, these state that for the 1988 model year, the maximum allowable level of solid particulates emitted is 0.6 grams per brake-horsepower-hour. For the 1991 model year, this level drops to 0.25 grams for trucks and 0.10 grams for buses, and, for the 1994 model year, the level is set at 0.10 grams for all such vehicles. These standards present scientists with more difficult challenges in the areas of diesel engine component and combustion system design and advanced fuel technology.

One approach reportedly being considered for helping to meet these goals is that of reducing the aromatic content of diesel fuel, now typically in the range of 30 to 35 volume percent, to below about 20 volume percent, and the sulfur content to below about 0.05 weight percent. It is estimated that making such changes in diesel fuel would cost at least 15 to 20 cents per gallon at the refinery level. Price increases at the consumer level would be expected to be somewhat higher.

Another approach is described by Nichols, Jr. in U.S. Pat. No. 4,240,802, wherein the addition of a minor amount of a cyclopentadienyl manganese tricarbonyl and a lower alkyl or cycloalkyl nitrate to a hydrocarbon fuel is disclosed. These compounds are described as useful in reducing carbonaceous particulate emissions from fuel oil. However, the manganese content in such an additive creates problems with $MnO_x$ emissions in that they are toxic, and the overall weight of solid particulate matter removed from the exhaust is relatively unchanged.

SUMMARY OF THE INVENTION

The present invention is founded on the surprising discovery that dimethyl carbonate is highly useful, when used as an additive in diesel fuel and the like, for reducing both carbon monoxide and particulate emissions upon combustion of the fuel. This discovery is especially surprising in view of the fact that test comparisons show that compounds related to dimethyl carbonate, i.e., other alkyl carbonate esters where the esterifying moiety has two or more carbon atoms, do not exhibit the same pollution-reducing properties as dimethyl carbonate.

Accordingly, the invention provides a relatively low cost method for reducing air pollution due to introduction of particulate matter and carbon monoxide into the air, said method comprising combusting a diesel fuel containing dimethyl carbonate in a particulate-reducing concentration. This method is most particularly taken advantage of when a large number of vehicles in a congested area are supplied each day with such composition. In a preferred embodiment of the invention, diesel fuel produced in a refinery is subsequently, and most preferably on a continuous basis, blended with dimethyl carbonate to provide a particulate-reducing concentration thereof, the resulting composition of the invention then being delivered to a number of service stations in a given governmental district such as a county or city of relatively high population. While oil refineries vary considerably in size, production facilities, and feed stocks processed, it is anticipated that the above production operations will be performed in a facility refining at least 30,000 barrels (1,260,000 gallons) of crude oil per day.

DETAILED DESCRIPTION OF THE INVENTION

The present invention relates to hydrocarbon dimethyl carbonate (DMC) added thereto in an amount sufficient to reduce the levels of carbon monoxide and/or particulate emissions resulting from combustion of said fuel in a diesel engine By lowering the amount of such pollutants spewed into the air, a significant improvement in air quality in a heavily industrialized area such as that encompassed by Los Angeles and Orange Counties, collectively known as the Los Angeles Basin, in California, where the total population is over 13 million, can be realized. It is estimated that in excess of 500,000 diesel-powered automobiles, trucks, buses, locomotives, marine engines, and stationary power supplies daily transit and/or are in use in this area, and the average daily consumption of diesel fuel by all of these units is estimated to be about 3,500,000 gallons (i.e., about 100,000,000 gallons a month). As will be shown herein below, DMC is uniquely efficacious in preventing such emissions as compared to diethyl, dipropyl, and higher dialkyl carbonate esters.

The fuel compositions of the invention may be prepared by simply blending dimethyl carbonate into diesel fuel. Because DMC is highly soluble in diesel fuel, only mild agitation is needed, at most, to ensure that a homogeneous solution will be produced No other changes in refinery practices are needed. The DMC additive is introduced into a diesel fuel in an amount which will effect at least some reduction of particulate emissions upon combustion of the fuel (i.e., soot reduction). Generally speaking, particulate reductions will not be significant when the DMC is present in concentrations below about 0.5 volume percent, and because DMC is contemplated as an additive to the diesel fuel, it will normally not be present in concentrations above about 49.9 volume percent. In the most usual case, DMC is provided in an amount resulting in DMC concentrations no greater than about 20 volume percent.

It is generally the case that the more DMC which is provided to the diesel fuel, the better the pollution reduction achieved upon combustion. Thus, the exact amount to be utilized in a given situation will vary, depending upon the amount of pollution reduction desired, balanced against the cost of the added DMC. As a rule, additive concentrations from about 0.5 to less than 3.0 volume percent, e.g., 0.5 to 2.5 volume percent, provide noticeable particulate and carbon monoxide reductions, e.g., on the order of 10%, as shown hereinafter in Example 33. Higher concentrations, e.g., above 3.0 volume percent to below 5.0 volume percent, are expected to provide even better results, and because the data in Example 32 hereinafter show average particulate reductions on the order of about 19% at driving speeds in the range of 20 to 55 mph, it can be expected that still better results can be attained above 5 volume percent, e.g., from above 5 volume percent to below or at 10 volume percent. Best results of all, however, are expected above 10 volume percent, with concentrations above 10 to about 20 volume percent being preferred.

The above pollution reductions need not be attained at the price of either reduced engine performance or the need to modify typical automotive diesel engines. In the experimental runs detailed in Examples 32 and 33, the procedure called for alternating the base fuel and the DMC additive-containing fuel in the test engine. No significant difference was observed in power output. Further, exposure to DMC fuels in these tests did not indicate any particular problems with gasket or seal failure, and although DMC is known to attack rubber, the fuel hoses in the engines used did not appear to show any degree of accelerated wear at the conclusion of the tests in these examples.

The present invention, as contemplated in the preferred embodiment, entails the production of a base diesel fuel in a refinery or other facility producing such fuel and the blending of DMC to provide a desired particulate-reducing and/or CO-reducing concentration therein. Diesel fuel can, of course, be produced by fractionally distilling a whole crude oil so as to obtain a diesel fraction boiling in the range of 300° F. to about 700° F. Alternatively, diesel fuel may be produced by appropriately cracking or hydrocracking a hydrocarbon stream boiling in whole or in part above 700° F. so as to produce or increase the yield of such fuel. Such operations usually take place in an oil refinery, and it is preferred that such blending take place either within the refinery facility as part of its usual operations or at one of its major distribution terminals, the blended fuel then being distributed to storage facilities including both above-ground and underground tanks, barges, automotive service stations and the like where it can be sold and/or otherwise dispensed for use in diesel engines. It is understood that there are many instances, such as at construction sites, where the fuel is delivered directly from the refinery or terminal and pumped or otherwise inserted directly into the fuel tanks of the operating engines. The particular method by which the carbonate-containing fuel of the present invention is put into final use is of minor significance.

Because the benefits of the invention increase directly with the number of diesel engine users who convert from using normal fuel to the DMC-containing compositions of the present invention, it is highly preferred that, on a given day, at least 1,000 and preferably at least 10,000 engines be provided with the fuel composition of the present invention within a state or a densely populated area, i.e., within a county, city, or other governmental district encompassing a city of 500,000 or more people. Most preferably of all, the amount of diesel fuel sold and combusted within such a governmental district will be sufficient to effect a noticeable decrease in the amount of combustion particulates and carbon monoxide emitted by said engines. At the present time, it is believed that, if as little as 10% of the diesel fuel sold within a given governmental district were the diesel fuel composition of the present invention, a noticeable decrease in these pollutants would be observed. If at least 50% of the fuel sold were the composition of the present invention, it is believed, based on the data presented in the Examples hereinbelow, that reductions in emitted particulates and carbon monoxide at least as high as 10% could be observed (depending, of course, upon the DMC concentration in the fuel sold). Still more preferred is that, of the diesel fuel sold in a given governmental district, at least 75%, even more preferably at least 90%, and most preferably of all, 100% of the diesel fuel is a composition containing DMC in a sufficient proportion to cause particulate reductions.

A typical diesel fuel specification includes a minimum flash point of 100° F., a boiling point range of from about 300° F. to about 700° F., and maximum 90 percent distillation point (ASTM D-86) of 640° F., i.e., 90 percent by volume boils below 640° F. (See ASTM Designation D-75.) The hydrocarbon fuel composition of the present invention may also comprise any of the known conventional additives, such as cetane improvers, dyes, oxidation inhibitors, etc., which are customarily used in commercially available diesel fuels.

The invention is further described in the following Examples, which are illustrative and not intended to be construed as limiting the scope of the invention as defined in the claims.

EXAMPLE 1

A series of 100 ml graduated cylinders respectively containing 91, 95, 99, and 99.5 ml of a commercially available No. 2 diesel fuel were mixed with sufficient dimethyl carbonate to bring the final volume to 100 ml. Each of these mixtures was then stirred at room temperature in a beaker for about 30 minutes and then allowed to sit for an additional 30 minutes. Solubility was determined by a standard procedure in which a specified mixture forms a homogeneous liquid (i.e., a single layer) having no cloudiness. (See Vogel's Textbook of Practical Organic Chemistry, Fourth Edition, Longman, London, 1978, page 940.) Examination of these samples showed that, in each case, DMC was fully miscible in diesel fuel.

EXAMPLES 2-31

The following examples demonstrate the reduction of particulate emissions from the combustion of a gaseous hydrocarbon fuel, propane, flowing at rates of 0.20, 0.23, and 0.25 liters/minute, when a carbonate is added thereto. The procedure for measuring particulate emissions involves combusting the propane in a laminar diffusion flame. Such a test has been found to provide a very fuel-rich combustion environment which simulates the combustion conditions inside a diesel engine. This is because it has been found that the flame inside a diesel engine is a diffusion flame and particulate matter formed as a result of said combustion is largely formed in the very fuel-rich area of the diffusion flame. Consequently, propane diffusion burner tests are reasonable means for screening proposed combustion particulate emissions-reducing additives for diesel fuel and determining their relative capabilities In these Examples, the lowest propane flow rate represents a typical fuel-rich combustion environment and the highest value represents a very fuel-rich environment.

In these tests, the flame is generated and stabilized using a 1.9 centimeter (cm) diameter capillary burner. The burner consists of three concentrically positioned stainless steel tubes which have respective inner diameters of 0.4 cm, 1.1 cm, and 1.8 cm. Positioned within and between these tubes are stainless steel hypodermic tubes (0.84 millimeters (mm)). Propane, the desired amount of carbonate additive, and nitrogen are provided through the central tube with oxygen and nitrogen provided through the middle tube. Through the outer concentric tube, a shroud of nitrogen is provided to shield the flame from atmospheric oxygen. The oxygen, nitrogen, and propane are metered into the tubes of the burner through calibrated glass rotometers. The total flow rates of oxygen and nitrogen for all of the examples are 0.96 and 2.35 liters per minute (1/min), respectively.

Particulate emission rates are measured as a function of the three propane flow rates listed below in Table 1 for each example. The carbonate additive is added at a flow rate of 26.33 microliters/minute through a 90° "pneumatic" nebulizer and monitored with a motorized syringe pump. The burner is enclosed in a circular cross-sectional quartz chimney (7 cm inner diameter by 45 cm long) which is fitted with a filter holder for collecting particulate emissions. The carbonate additives used comprised dimethyl, diethyl, di-n-propyl, diisopropyl, and di-n-butyl carbonate. Test durations were 5 minutes for each example shown in Table 1. Fuel using no additive was also run to provide a comparison with the present invention The particulate emission rates are measured by drawing the exhaust out of the chimney through a fluorocarbon-coated glass fiber filter using a rotary vane vacuum pump. The weight of particular matter collected on the filter is determined by weighing the filter before and after the test and subtracting the former from the latter.

TABLE 1

| | Example No. | Propane Flow Rate (liters/min) | Additive Flow Rate Microliters/min) | Mean Particulate Emission Rate (mg/min) | No. of Tests | Particulate Reduction (percent) |
|---|---|---|---|---|---|---|
| Dimethyl Carbonate | 2 | 0.20 | 0 | 9.96 | 22 | |
| | 3 | 0.20 | 26.33 | 9.76 | 4 | 2.0 |
| | 4 | 0.23 | 0 | 11.73 | 24 | |
| | 5 | 0.23 | 26.33 | 10.89 | 12 | 7.1 |
| | 6 | 0.25 | 0 | 11.18 | 26 | |
| | 7 | 0.25 | 26.33 | 10.45 | 12 | 6.4 |
| Diethyl Carbonate | 8 | 0.20 | 0 | 9.96 | 22 | |
| | 9 | 0.20 | 26.33 | 9.98 | 2 | 0 |
| | 10 | 0.23 | 0 | 11.72 | 27 | |
| | 11 | 0.23 | 26.33 | 11.64 | 1 | 0 |
| | 12 | 0.25 | 0 | 11.17 | 30 | |
| | 13 | 0.25 | 26.33 | 11.11 | 6 | 0 |
| Di-n-propyl Carbonate | 14 | 0.20 | 0 | 9.98 | 11 | |
| | 15 | 0.20 | 26.33 | 10.05 | 5 | 0 |
| | 16 | 0.23 | 0 | 12.01 | 14 | |
| | 17 | 0.23 | 26.33 | 12.10 | 5 | 0 |
| | 18 | 0.25 | 0 | 10.98 | 14 | |
| | 19 | 0.25 | 26.33 | 10.88 | 6 | 0 |
| Di-isopropyl Carbonate | 20 | 0.20 | 0 | 9.98 | 11 | |
| | 21 | 0.20 | 26.33 | 10.09 | 3 | 0 |
| | 22 | 0.23 | 0 | 12.01 | 14 | |
| | 23 | 0.23 | 26.33 | 11.92 | 4 | 0 |
| | 24 | 0.25 | 0 | 10.98 | 14 | |
| | 25 | 0.25 | 26.33 | 10.85 | 3 | 0 |
| Di-n-butyl Carbonate | 26 | 0.20 | 0 | 9.98 | 11 | |
| | 27 | 0.20 | 26.33 | 10.05 | 4 | 0 |
| | 28 | 0.23 | 0 | 12.02 | 14 | |
| | 29 | 0.23 | 26.33 | 12.02 | 5 | 0 |
| | 30 | 0.25 | 0 | 10.98 | 14 | |
| | 31 | 0.25 | 26.33 | 10.98 | 5 | 0 |

Note that, in all cases, the data clearly show that DMC does effect a significant reduction in particulate emissions as compared to fuels run without any additive, whereas fuels run with dialkyl carbonates other than DMC show no such effect, regardless of which flow rate was used. The small differences in emissions reduction, which are represented by "0" percentage values when diethyl, di-n-propyl, diisopropyl, and di-n-butyl carbonate are used, are, statistically, not significant at the 95-percent confidence level when evaluated by a double-tailed Student's t-test. When the results with DMC are evaluated by the same procedure, there is a 95-percent confidence level that the level of soot reduction achieved with a 0.20 liter/minute propane flow rate is significant (Example 3) and 99.9 percent levels of confidence in the significance of the soot reductions observed at propane flow rates of 0.23 and 0.25 liters/minute (Examples 5 and 7).

EXAMPLE 32

Tests to determine emissions of particulates from diesel engines were conducted on a chassis dynamometer using a heavy-duty diesel test vehicle connected to a Constant Volume Sampling (CVS) emissions test system. The heavy-duty test vehicle was a 1982 International Harvester (IH) Cargostar 1840B equipped with a IH DTI466 direct-injection diesel engine. Chassis dynamometer loading was adjusted to simulate a vehicle loaded with 26,000 pounds gross combined weight (GCW), with measured and calculated load data being taken from Society of Automotive Engineers (SAE) Paper 840349 entitled "Dynamometer Simulation of Truck and Bus Road Horsepower for Transient Emissions Evaluations." The experimental technique for collecting and measuring particulate emissions is an adaptation of the Environmental Protection Agency (EPA) Federal Test Procedure (FTP) for light-duty diesel vehicles described in 40 CFR 86, Subpart N. A 1,200 cubic foot per minute (cfm) exhaust splitter was used to channel one-half of the exhaust from the test engine into a 600 cfm Beckman CVS emissions test system where it was diluted with air in accordance with the EPA test procedure. Particulate emissions were collected on fluorocarbon-coated glass fiber filters, which were weighed to determine, by difference, the mass of the particulates emitted during the test run.

The distance the vehicle travelled was recorded by a resettable counter receiving input from an optical encoder driver by the chassis dynamometer rolls. Results of the particulate emissions tests were calculated on a grams-per-mile basis.

During testing, a series of runs with fuel containing additive were bracketed between two series of runs using a base fuel containing no additive. Each series of runs contained in sequence hot-start, steadystate, and transient tests. During the steady-state segment of the series, triplicate steady-state runs lasting 10 minutes were conducted at each of five engine speeds: 55, 40, 30, and 20 miles per hour, and at idle. In addition, three modified Highway Fuel Economy Tests (HFET) were run for each series.

A single lot of commercially available No. 2 diesel fuel was used as the base fuel for all tests, with 5.3 weight percent (5 volume percent) of dimethyl carbonate added during the additive tests.

Results of the diesel particulate emissions tests are summarized in Table 2. In runs containing the carbonate additive, the mean particulate emissions are reduced as much as 29 percent compared to emissions from runs containing no additive under all test conditions except idle. The variability in particulate emissions at idle is so large that comparison between the base fuel runs and additive runs, under the conditions summarized in Table 2, are probably not valid.

TABLE 2

Reduction in Particulate Exhaust Emissions From a Heavy-Duty Diesel Engine Truck

| Steady-State Speed (mph) Test | Mean Particulate Emissions with No. 2 Diesel Base Fuel (grams/mile) | Mean Particulate Emissions With 5.3 Weight Percent Dimethyl Carbonate Added to No. 2 Diesel Base Fuel (grams/mile) | Particulate Reduction in Percent |
|---|---|---|---|
| 55 | 0.683 | 0.525 | 23 |
| 40 | 0.674 | 0.616 | 9 |
| 30 | 0.654 | 0.464 | 29 |
| 20 | 0.902 | 0.776 | 14 |
| Idle (a) | 0.840 | 0.880 | 0 |
| HFET (b) | 0.671 | 0.520 | 23 |

(a) Idle emissions are per 10-minute test. The small difference in particulate emissions reduction, which is represented by a "0" value for percent particulate reduction at idle is statistically not significant at the 95 percent confidence level, when evaluated by a double-tailed Student's t-test.
(b) The FTP Highway Fuel Economy Test was modified to meet the slower accelerations and decelerations of a heavy-duty vehicle.

EXAMPLE 33

A second series of diesel engine test was run. In these, the engine was a 6-cylinder, direct-injection turbocharged Cummins NTCC 350 "Big Cam III" diesel engine having an 855 cubic inch displacement block and equipped with a California emissions control package.

For these tests, Phillips D-2 diesel control fuel was used as the reference fuel, both along and with a dimethyl carbonate concentrate of 2.5 volume percent. The test procedure used was as defined in Environmental Protection Agency Emissions Certification Procedure 40 CFR 86, subpart N (as amended 10/15/84), and is representative of two identical 20-minute cycles comprising several quick accelerations to full power, with most of the cycle time being spent at engine idle. The first 20-minute cycle is a cold-start cycle; the second 20-minute cycle is a hot-start cycle, and a 20-minute soak period is inserted in between the two cycles. Results of the two cycles are weighted 1/7 for the first cold cycle and 6/7 for the second hot cycle. In addition to the above transient cycles, an additional 20-minute steady-state cycle was run at 25% load and at the rated speed of 1800 rpm. A total of 34 such combined runs were made. The results attained in these test runs are summarized in Table 3.

TABLE 3

| Fuel | Mean Particulate Emission Rate (g/bhp-hr) | Standard Deviation (g/bhp-hr) | Percent Reduction in Particulate Emission Rate |
|---|---|---|---|
| EPA EMISSIONS CERTIFICATION PROCEDURE | | | |
| Base | 0.59 | 0.028 | |
| Base + 2.5% DMC | 0.53 | 0.019 | 10.2 |
| COLD-START TRANSIENT CYCLE | | | |
| Base | 0.68 | 0.031 | |
| Base + 2.5% DMC | 0.61 | 0.050 | 10.3 |
| HOT-START TRANSIENT CYCLE | | | |
| Base | 0.57 | 0.016 | |
| Base + 2.5% DMC | 0.51 | 0.019 | 10.5 |
| STEADY-STATE CYCLE | | | |
| Base | 0.82 | 0.015 | |
| Base + 2.5% | 0.77 | 0.028 | 6.1 |

TABLE 3-continued

| Fuel | Mean Particulate Emission Rate (g/bhp-hr) | Standard Deviation (g/bhp-hr) | Percent Reduction in Particulate Emission Rate |
|---|---|---|---|
| DMC | | | |

Tests of significance in regard to the above-reported data were made. This was to determine whether there was a statistically significant difference between the mean values for the base fuel alone and with the dimethyl carbonate, at the 95% confidence level, using a Fisher's least significant difference test. This procedure involves performing replicate t-tests on the data and controls the maximum comparisonwise error rate. By so doing, there is a high probability that a difference between the two mean values will not be missed In the above table, there is a 95% confidence that the differences observed between the unmodified base fuel and the dimethyl carbonate treated fuel, in all of the test runs, are significant.

In addition to the particulates measurements, the federal test procedure also called for measurements of the carbon monoxide (CO), $SO_x$, $NO_x$, and hydrocarbon contents in the exhaust gases These measurements showed that while the addition of DMC to diesel fuel had little or no effect on the $SO_x$, $NO_x$, and hydrocarbon levels observed, the level of CO was reduced by about 7 to 10 percent over the entire EPA Certification Procedure and by 15 to 20 percent during the hot start transient portion of this procedure.

In view of the foregoing description of the invention, as well as the data in the examples, it can be seen that the invention lends itself to many embodiments to combat air pollution.

In one embodiment, at least 10, preferably at least 50, more preferably at least 75, and most preferably 100% of the diesel fuel produced at an oil refinery is blended with at least 0.5, preferably 0.5 to 2.5, and more preferably 0.5 to 20.0 volume percent DMC before it is distributed and consumed.

In another embodiment, DMC blended diesel fuel is distributed to storage facilities, e.g., service stations in cities or counties having populations ranging from 5,000 to well in excess of 1,000,000 with at least 10%, preferably at least 25%, more preferably at least 75%, and most preferably 100 percent of the diesel engines therein consuming said fuel on any given day. Alternatively, at least 1,000, preferably at least 10,000 vehicles are supplied per day with said fuel. Preferably, the fuel is delivered for consumption to service stations and the like over at least a month's time, even more preferably, at least 6 months, with the consumption rate most preferably being 10 million gallons weekly.

In still a third embodiment, a fleet of at least 10 diesel-engined vehicles is operated with fuel blended with at least 1% DMC.

In a fourth embodiment, a single diesel-engined vehicle is operated with said fuel for at least a week, preferably at least a month, even more preferably, six months, with said vehicle preferably consuming at least 2,000 gallons of fuel containing between at least 0.5 to 2.5 volume percent DMC, the amount of DMC preferably being sufficient to reduce both combustion particulates and carbon monoxide by at least 5 percent, preferably by at least 10 percent.

In all cases, the use of DMC-treated diesel fuel holds forth the promise of reducing levels of carbon monoxide and combustion emission particulates, e.g., to at least 5% and even at least 10% lower than would be the case with similar fuels not containing DMC.

ADVANTAGES OF THE INVENTION

The above examples demonstrate the invention using both diesel fuel and propane as the hydrocarbon fuel. They also illustrate that, under combustion conditions which result in formation of particulates from diesel fuels, when tested by the procedures defined by the EPA as being representative of the conditions involved in urban driving, the amount of both particulate emissions and carbon monoxide are significantly reduced by adding dimethyl carbonate to the fuel before combustion.

In this regard, as shown in Examples 32 and 33, during steady-state operation, combustion particulate emission reductions between 10% and 30% are possible when 5%, by volume, dimethyl carbonate is blended into diesel fuel Further, since these results are superior to the 6.1% reduction observed with a 2.5% DMC addition in Example 33, it is clear that higher DMC addition levels of, perhaps 10, 15, or even 20 volume percent would achieve still better results.

The effectiveness of DMC is, surprisingly, found to extend to yet another area of environmental concern—that of reducing the amount of carbon monoxide in diesel exhaust gases where average reductions of at least 5 to, and, in some cases, in excess of, 10 percent have been shown. Lastly, since dimethyl carbonate is an all-organic additive, its combustion in a diesel engine does not create any problems with metallic particulates being added to the exhaust gas.

All these advantages can be obtained at a relatively low cost. At the present time, dimethyl carbonate costs less than $.90/pound so the incorporation of about 2.5 volume percent DMC to a gallon of diesel fuel, as in Example 33, would cost about 6 cents as compared to the estimated 15-20 cent cost of achieving much the same results by lowering the aromatic and sulfur contents of the base fuel. Further, since DMC is a liquid which is soluble in diesel fuel, a simple blending operation is all that is needed to accomplish this result. No other changes in production facilities, catalysts, and feed stocks used are necessary. Neither is there a need to increase the percentages of other additives, such as detergents, corrosion inhibitors, cetane improvers, etc To fully appreciate the significance of such a capability, consider the fact that in the Los Angeles basin alone, which has a population in excess of about 13 million people, there are over 500,000 diesel-powered cars, trucks, busses, locomotives, marine vessels, and stationary power sources which consume, perhaps, as much as 3,500,000 gallons of diesel fuel daily In view of the overall quantity of combustion emission particulate and carbon monoxide pollutants which such operation must produce, the potential of the fuels of the present invention to reduce two such major pollutants by anywhere from 5 to 30 percent holds forth the promise of promoting significant improvement in overall air quality, especially in densely populated, industrialized areas where the number of diesel-powered vehicles is fairly large. Consequently, while the invention can be used to reduce both the particulate emissions and the carbon monoxide resulting from the combustion of any hydrocarbon fuel, it is particularly preferable when the fuel is diesel fuel. It is, of course, understood that, in highly polluted areas, the improvements in air quality which the use of DMC-blended fuels can accomplish will not take place overnight, even if every diesel engine operating in said area were to be switched over to said fuel all at once. Rather, it is expected to take some period of continuous use of these fuels before such improvements become detectable. Where fewer than 100% of the engines use said blended fuel, the amount of time required to observe the aforesaid particulate and carbon monoxide reductions will be longer. When only 25% of the engines operate with said fuel, it is estimated such a time would be about 6 months.

This application incorporates by reference patent application Ser. No. 811,953 filed Dec. 20, 1985, in its entirety Obviously, many modifications and variations of the invention, as hereinbefore set forth, may be made without departing from the spirit and scope thereof. For example, although the invention is primarily directed to use with liquid hydrocarbon fuels boiling in the range of 300° to 700° F., it can be seen that the invention can also be advantageously employed with gaseous hydrocarbon fuels such as methane, ethane, propane, acetylene, or natural gas. Also, although reference has been made to diesel fuel from petroleum distillation as one preferred fuel, the invention may also be used successfully with other middle distillates, such as heating oils, aviation fuels, etc., which are produced from petroleum sources or from shale, coal, or tar sands. Accordingly, it is intended in the invention to embrace these and all such alternatives, modifications, and variations as fall within the spirit and scope of the appended claims.

What is claimed is:

1. A method for reducing the levels of air pollution resulting at least in part from the combustion of diesel fuel in diesel engines, said method comprising:

(a) deriving, in an oil refinery, a diesel fuel from a whole crude or a fraction thereof;

(b) then blending at least 10 volume percent of the diesel fuel produced per day from said refinery with dimethyl carbonate so as to provide a diesel fuel composition containing dimethyl carbonate in a concentration of at least about 0.5 volume percent, followed by;

(c) delivering a major portion of said blended fuel composition to storage facilities supplying fuel for use with said diesel engines; and (d) combusting said blended fuel in said engines.

2. The method of claim 1 wherein at least 50 volume percent of the diesel fuel produced at said refinery is blended with dimethyl carbonate.

3. The method of claim 2 wherein at least 75 volume percent of said diesel fuel is blended with dimethyl carbonate.

4. The method of claim 1 wherein said refinery has a capacity of at least 20,000 barrels of crude oil per day.

5. The method of claim 1 wherein the amount of diesel fuel blended with dimethyl carbonate is at least 30,000 gallons per day.

6. The method of claim 1 wherein step (c) comprises transporting said blended fuel to the operating sites of said diesel engines and inserting said fuel into fuel tanks supplying said engines.

7. The method of claim 1 wherein said carbonate concentration is between about 0.5 and about 2.5 volume percent.

8. The method of claim 1 wherein said carbonate concentration is greater than 3.0 and less than 5.0 volume percent.

9. The method of claim 1 wherein said carbonate concentration is between 5.5 and 9.5 volume percent.

10. The method of claim 1 wherein said carbonate concentration is greater than 10 volume percent.

11. A method for reducing the levels of air pollution in a governmental district, said pollution resulting, at least in part, from the combustion of diesel fuel in diesel engines operating within said district, said method comprising:

(a) deriving, in an oil refinery, a diesel fuel from a whole crude or a fraction thereof;

(b) then blending at least 10 volume percent of the diesel fuel produced per day from said refinery with dimethyl carbonate so as to provide a blended diesel fuel composition having a particulate reducing carbonate concentration therein, followed by;

(c) delivering said blended fuel composition for use with said diesel engines; and (d) combusting said blended fuel in said engines.

12. The method of claim 11 wherein said governmental district is a city.

13. The method of claim 12 wherein said governmental district is a county.

14. The method of claim 13 wherein said county has a population of at least 500,000 and the number of diesel engines using said blended fuel therein is at least 1000.

15. The method of claim 11 wherein the total amount of blended fuel delivered is at least 50,000 gallons per day.

16. The method of claim 14 wherein at least 100,000 gallons of said blended fuel is delivered per day.

17. The method of claim 6 wherein said carbonate concentration is between about 11 and about 20 volume percent.

18. The method of claim 11 wherein said carbonate concentration is greater than 5 and less than 10 volume percent.

19. The method of claim 17 wherein said diesel engines are fueled with said blended fuel for at least one month.

20. The method of claim 11 wherein said carbonate concentration is above 3.0 and below 5.0 volume percent and the amount of blended fuel produced with said carbonate added thereto is at least 25 volume percent of daily diesel fuel production at said refinery.

21. The method of claim 11 wherein said carbonate concentration is between 0.5 and 2.5 volume percent and the amount of blended fuel produced with said carbonate added thereto is at least 50 volume percent of daily diesel fuel production at said refinery.

22. A method for providing a fuel causing reduced levels of air pollution resulting from the combustion thereof in a state comprising:

(a) deriving in one or more oil refineries a diesel fuel from a whole crude oil or fraction thereof;

(b) then blending said diesel fuel with dimethyl carbonate so as to provide a fuel composition having a concentration of said carbonate of at least about 0.5 volume percent, followed by:

(c) delivering at least some of said blended fuel composition to service stations; and (d) fueling, from the total of said service stations, at least 1,000 automotive vehicles operating with a diesel engine, with said blended composition.

23. The method of claim 22 wherein at least 10,000 vehicles per day are fueled with said fuel composition.

24. The method of claim 22 wherein at least 1,000 vehicles per day are fueled with said fuel composition over a period of at least one month, with all of said vehicles being fueled being operated within the limits of said state.

25. The method of claim 22 wherein the total amount of said fuel composition delivered to said service stations is at least 100,000 gallons per day.

26. A method for reducing air pollution within a county having a population of at least 500,000 persons comprising delivering from at least 10 percent of the service stations within the limits of said county into diesel-powered automotive vehicles a fuel composition consisting essentially of hydrocarbons boiling within the range of about 300° F. and about 700° F., with dimethyl carbonate added to said fuel in an amount sufficient to reduce the amount of particulate matter and carbon monoxide formed during combustion of said fuel in said diesel engine as compared to the same fuel used without said dimethyl carbonate being added.

27. The method of claim 26 wherein the concentration of dimethyl carbonate in said fuel composition is at least 0.5 volume percent, and the percentage of service stations within said county providing said fuel is at least 25.

28. The method of claim 26 wherein the concentration of dimethyl carbonate in said fuel composition is at least 2.0 volume percent and the percentage of service stations within said county is at least 25.

29. The method of claim 26 wherein the concentration of dimethyl carbonate in said fuel composition is at least 2.5 volume percent and the percentage of service stations within said county is at least 50.

30. The method of claim 27 wherein the total quantity of fuel delivered to said stations over one week's time is at least 10,000,000 gallons.

31. The method of claim 30 wherein the total population of said county is at least about 1,000,000 persons.

32. The method of claim 30 wherein the population of said county is at least about 5,000,000 persons.

33. The method of claim 30 wherein the population of said county is at least about 2,500,000 persons.

34. The method of claim 30 wherein the population of said county is at least about 10,000,000 persons.

35. A method for reducing air pollution comprising operating a fleet of automotive vehicles operating on diesel fuel, said fleet comprising at least 10 of said vehicles with a fuel composition comprising hydrocarbon diesel fuel and dimethyl carbonate in a concentration of at least 1.0 volume percent.

36. A method for reducing air pollution comprising operating an automotive vehicle containing a diesel engine over a time period of at least one week with a fuel composition comprising diesel fuel and dimethyl carbonate in a particulate reducing concentration.

37. The method of claim 36 wherein said time period of operation is at least six months.

38. The method of claim 37 wherein the amount of fuel consumed by said vehicle is at least 2,000 gallons and said fuel composition is supplied to said vehicle in preblended form.

39. A fuel composition comprising diesel fuel and dimethyl carbonate, said carbonate comprising more than about 0.5 volume percent of the total volume of said composition, the composition having the property of releasing less carbon monoxide and fewer particulate emissions upon combustion in a diesel engine than would the fuel without the carbonate.

40. The composition of claim 39 wherein said carbonate is present in an amount between about 0.5 and about 2.5 volume percent.

41. A composition comprising diesel fuel and a combustion emission particulate- and carbon monoxide-reducing amount of dimethyl carbonate.

42. The composition of claim 41 wherein dimethyl carbonate is present in an amount such that the levels of combustion emission particulates and carbon monoxide are each reduced by at least 5 percent when such composition is combusted, as compared to the emissions observed with the same diesel fuel not containing dimethyl carbonate.

43. The composition of claim 42 wherein the levels of combustion emission particulate and carbon monoxide reduction are each at least 10 percent.

44. A method for reducing air pollution comprising the step of combustion in a diesel engine a fuel composition comprising diesel fuel with an amount of dimethyl carbonate, said composition having the property of reducing the levels of combustion emission particulates and carbon monoxide emitted by said engine each by at least 5% as compared to the emissions observed with same diesel fuel not containing dimethyl carbonate.

45. The method of claim 44 wherein said levels of combustion emission particulates and carbon monoxide reduction are each at least 10 percent.

46. The method of claim 44 further comprising the step of determining the level of combustion particulates emitted by the procedure of 40 CFR 86, Subpart N, for diesel engines.

47. A method for reducing air pollution comprising supplying within the limits of a county of at least 500,000 persons a sufficient amount of a diesel fuel composition to diesel-powered automotive vehicles so as to effect detectable reductions in combustion emission particulates and carbon monoxide in air sampled within said county, said composition comprising diesel fuel and a particulate-reducing amount of dimethyl carbonate.

48. A method as defined in claim 47 wherein the amount of particulate and carbon monoxide reduction is at least 1% in comparison to air sampled within said county when significant quantities of fuel comprising added dimethyl carbonate is not supplied to automotive vehicles.

* * * * *